United States Patent [19]

Lauterbach et al.

[11] Patent Number: 4,660,531

[45] Date of Patent: Apr. 28, 1987

[54] FUEL INJECTION SYSTEM

[75] Inventors: Heinz Lauterbach, Esslingen; Wolfgang Kienzle, Schwieberdingen; Ewald Ziegler, Heimsheim, all of Fed. Rep. of Germany

[73] Assignee: Robert Bosch GmbH, Stuttgart, Fed. Rep. of Germany

[21] Appl. No.: 395,877

[22] Filed: Jul. 7, 1982

[30] Foreign Application Priority Data

Aug. 17, 1981 [DE] Fed. Rep. of Germany ..... 3132432

[51] Int. Cl.[4] ..... F02M 55/02

[52] U.S. Cl. ..... 123/456; 123/459; 123/469; 239/550

[58] Field of Search ..... 123/456, 468, 470, 469, 123/459, 516, 514, 52 M; 239/550, 551, 600

[56] References Cited

U.S. PATENT DOCUMENTS

| | | | |
|---|---|---|---|
| 3,776,209 | 12/1973 | Wertheimer et al. | 123/470 |
| 3,929,109 | 12/1975 | Chamberlain | 123/468 |
| 4,142,497 | 3/1979 | Long | 123/456 |
| 4,205,637 | 6/1980 | Ito et al. | 123/456 |
| 4,235,375 | 11/1980 | Melotti | 239/125 |
| 4,286,563 | 9/1981 | Fahim et al. | 123/469 |
| 4,295,452 | 10/1981 | Lembke et al. | 123/470 |
| 4,300,510 | 11/1981 | Ishida et al. | 123/459 |

*Primary Examiner*—Willis R. Wolfe, Jr.

*Attorney, Agent, or Firm*—Edwin E. Greigg

[57] ABSTRACT

A fuel injection system for internal combustion engines with multiple fuel injection valves. The fuel injection system includes a dimensionally stable fuel manifold distributor with nipple plug connections, by means of which the fuel is directed to the individual injection valves. The fuel manifold distributor is disposed over the injection valves and is pitched with respect to the horizontal, with a fuel injection connection located at the lowest point of said manifold and connected to the pressure side of a fuel pump, with a return line connection provided at the highest point of the fuel manifold distributor leading to a return flow line, over which a portion of the fuel may be redirected to a pressure regulator and from there to the suction side of a fuel tank to which the fuel pump is connected. The fuel manifold distributor design described here makes it possible for the vapor lock bubbles that are formed to enter the return flow line after the hot internal combustion engine has been switched off, and to be directed to the suction side of the fuel pump when said internal combustion engine is restarted, thus making it possible to avoid problems in starting.

3 Claims, 1 Drawing Figure

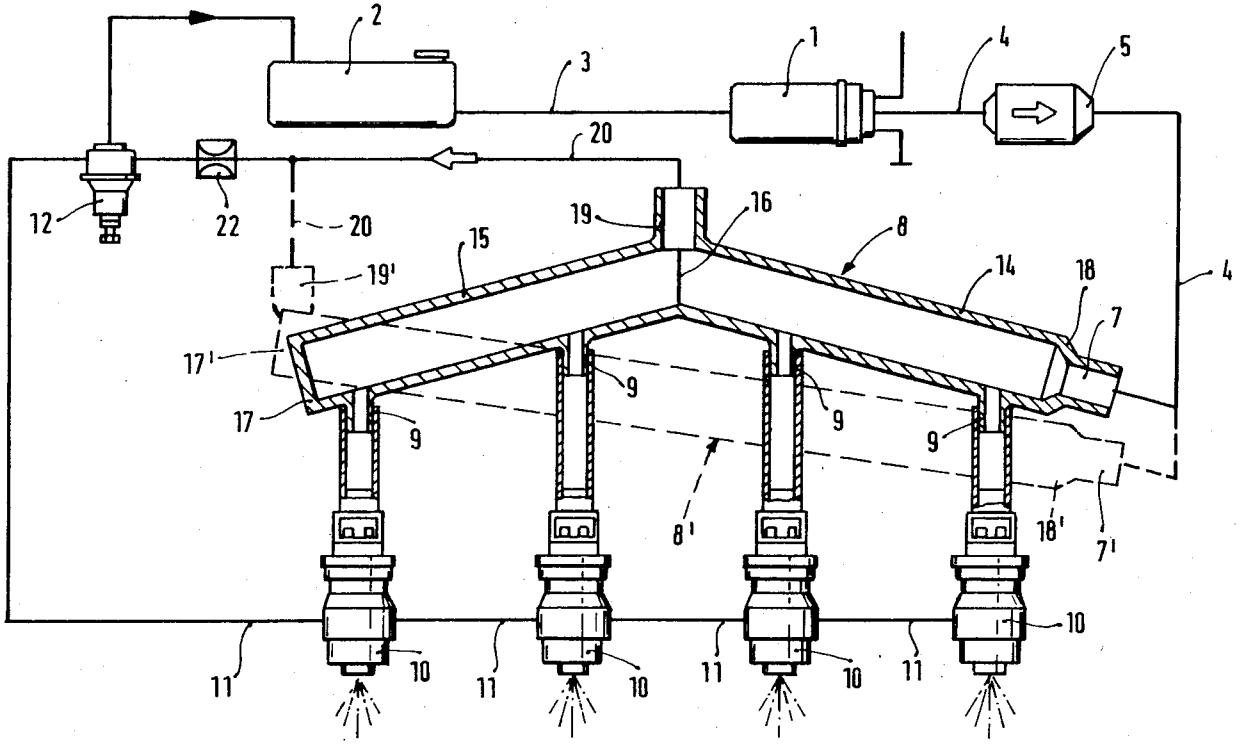
1
2
3
4
4
5
7
7'
8
8'
9
9
9
9
10
10
10
10
11
11
11
11
12
14
15
16
17
17'
18
18'
19
19'
20
20
22

FUEL INJECTION SYSTEM

BACKGROUND OF THE INVENTION

The invention is based on a fuel injection system for internal combustion engines with multiple valves. A fuel injection system with electromagnetic valve actuation is alreaady known, in which the injection valves are connected flush with a common, horizontally disposed fuel manifold distributor. It has the disadvantage, however, that when switching off the warmed-up internal combustion engine, vapor lock bubbles are formed in the injection valves and the fuel lines. When the internal combustion engine is started up once again, said vapor lock bubbles are transported to the injection valves, where sputtering and spark failure occur, and eventually engine failure as well.

OBJECT AND SUMMARY OF THE INVENTION

The fuel injection system according to the invention has the advantage over theprior art that the vapor lock bubbles entering the fuel line are not swept into the injection valves, and in this way, a more reliable engine start is assured in a heated-up condition as well.

The invention will be better understood and further objects and advantages thereof will become more apparent from the ensuing detailed description of a preferred embodiment taken in conjunction with the drawing.

THE DRAWING

The concrete example of the preferred embodiment of the invention is represented in a simplified form in the drawing and explained in more detail in the following description.

BRIEF DESCRIPTION OF THE PREFERRED EMBODIMENT

A preferably electric fuel pump 1 is shown in the drawing, which delivers fuel from a fuel tank 2 through a suction line 3 into a fuel line 4, through a fuel filter 5 in line 4 which leads to a connection 7 for a dimensionally stable fuel manifold distributor 8. Individual electromagnetically activated injection valves 10 are connected flush with said manifold distributor 8 by means of nipple connections 9, said injection valves are adjustable in a familiar manner by means of an electronic control device depending on the operation indicators of the internal combustion engine and disposed in said combustion engine serving to inject fuel into the manifold or cylinder. The fuel flowing to said injection valves 10 is partly redirected through a spill line 11 to a pressure regulator 12, in order to both cool the injection valves and prevent the formation of vapor lock bubbles and to prevent the excessively heated fuel from sputtering. The fuel manifold distributor 8 is designed according to the invention in such a way that it is spatially disposed over the injection valves 10, and is made in two sections 14, 15 pitched towards each other. The junction 16 of said sections 14 and 15 is disposed at their midsection at a higher horizontal position than the ends 17, 18. Fuel supply through the fuel line 4 is realized by means of connection 7 at the lowest position in the fuel manifold distributor 8, as represented for instance in the drawing at the end 18. At the highest point in the fuel manifold distributor 8, that is at the junction 16, a connection 19 is fitted from which a return line 20 is connected. The return line leads through a throttle device 22 to the pressure regulator 12, through which the fuel flows back to the fuel tank 2. If a heated internal combustion engine using the syste is switched off, the fuel in the injection valves 10 is heated up, and the escaping vapor lock bubbles rise upwards in the fuel manifold distributor 8 as a result of the pitch in sections 14 and 15 of said fuel manifold distributor 8 and collect in the area of junction 16, entering the return flow line 20 through connection 19. When the internal combustion engine is started once again, the vapor lock bubbles will return with the fuel flowing back through the return flow line 20 to the fuel tank without reaching the injection valves 10.

As shown in the drawing by means of the broken line, the fuel manifold distributor 8' may also be designed in the horizontal with a continuously rising pitch, so that connection 7' is disposed at the lowest position with respect to the horizontal in the fuel manifold distributor 4, and connection 19' is disposed at the highest point, leading to the return flow line 20. In this case also, the vapor lock bubbles collect in the region of connection 19' after switching off the hot internal combustion engine and are directed into the return flow line 20, assuring a reliable start-up of said internal combustion engine.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. A fuel injection system for internal combustion engines with multiple injection valves, comprising a common dimensionally stable fuel manifold distributor, said fuel manifold distributor being positioned above said injection valves and fitted with a return line connection, said return flow line redirecting fuel admitted to said manifold distributor through an input connection from a fuel pump connected to a fuel tank through a pressure regulator back to said fuel tank, said input connection of the fuel manifold distributor is disposed on the pressure side of the fuel pump and at the lowest point of said fuel manifold distributor, in which said fuel manifold distributor which distributes fuel to each of said multiple injection valves is on an angle with respect to the horizontal and connected to each of said injection valves via a nipple, said fuel manifold distributor has two sections joined at a central junction at an angle with respect to each other with the central junction of said sections disposed at a higher point than the ends of said fuel manifold distributor, and the connection to which said return flow line is connected is at said central junction which is the highest point of said fuel manifold distributor relative to horizontal.

2. A fuel injection system as claimed in claim 1 which includes a spill line connected between each of said injection valves with said spill line connected to said pressure regulator for cooling said valves and for preventing formation of vapor lock bubbles in said valves.

3. A fuel injection system as claimed in claim 1 which includes a spill line connected between each of said injection valves with said spill line connected to said pressure regulator for cooling said valves and for preventing formation of vapor lock bubbles in said valves.

* * * * *